US007438635B2

(12) United States Patent
Höglund

(10) Patent No.: US 7,438,635 B2
(45) Date of Patent: Oct. 21, 2008

(54) ABRASIVE PRODUCT HAVING PARALLEL BASE AND ABRASIVE THREADS

(75) Inventor: Göran Johannes Höglund, Nykarleby (FI)

(73) Assignee: OY KWH Mirka AB (FI)

( * ) Notice: Subject to any disclaimer, the term of this patent is extended or adjusted under 35 U.S.C. 154(b) by 322 days.

(21) Appl. No.: 10/957,801

(22) Filed: Oct. 4, 2004

(65) Prior Publication Data

US 2005/0124274 A1 Jun. 9, 2005

(30) Foreign Application Priority Data

Oct. 6, 2003 (FI) ..... 20031451

(51) Int. Cl.
*B24D 11/00* (2006.01)
*B24D 11/06* (2006.01)

(52) U.S. Cl. ..... 451/527; 451/528; 451/532

(58) Field of Classification Search ..... 451/526, 451/527, 528, 529, 532
See application file for complete search history.

(56) References Cited

U.S. PATENT DOCUMENTS

| | | | | |
|---|---|---|---|---|
| 1,561,727 | A | 11/1925 | Kingman | |
| 2,740,239 | A * | 4/1956 | Ball et al. | 451/536 |
| 2,984,052 | A * | 5/1961 | Mueller, Jr. | 451/536 |
| 3,861,892 | A * | 1/1975 | Wisdom et al. | 51/295 |
| 4,066,106 | A * | 1/1978 | Graham | 139/420 C |
| 4,133,147 | A | 1/1979 | Swift, Jr. | |
| 4,282,011 | A * | 8/1981 | Terpay | 51/298 |
| 4,503,114 | A * | 3/1985 | Cohen | 442/41 |
| 5,131,924 | A * | 7/1992 | Wiand | 51/293 |
| 5,168,006 | A * | 12/1992 | Inoguchi et al. | 442/187 |
| 6,190,246 | B1 * | 2/2001 | Parrott et al. | 451/540 |
| 6,676,530 | B2 * | 1/2004 | Lochtefeld | 472/117 |
| 2003/0013397 | A1 * | 1/2003 | Rhoades | 451/527 |

FOREIGN PATENT DOCUMENTS

| | | |
|---|---|---|
| DE | 3236134 | 9/1982 |
| JP | 61-138771 | 6/1986 |
| JP | 63144986 | 6/1988 |
| JP | 2001038632 | 2/2001 |

* cited by examiner

*Primary Examiner*—Timothy V Eley
(74) *Attorney, Agent, or Firm*—Altera Law Group, LLC

(57) ABSTRACT

The invention relates to an abrasive product intended to be driven in a particular grinding direction over the object to be abraded. The abrasive product is composed of parallel threads placed at a distance from one another and running in the grinding direction and transverse abrasive threads provided with an abrasive coating placed at a distance from one another and fastened to the parallel threads. The open structure allows to easily remove the grindings from the abrasive product during abrasion, thus extending the working life of the abrasive product.

10 Claims, 2 Drawing Sheets

ABRASIVE PRODUCT HAVING PARALLEL BASE AND ABRASIVE THREADS

TECHNICAL FIELD

The present invention relates to an abrasive product composed of a base comprising mutually parallel base threads, and an abrasive layer comprising mutually parallel abrasive threads placed at a distance from one another, which abrasive threads run substantially transversely in relation to the base threads and are fastened thereto.

BACKGROUND

Such abrasive products are previously known for instance from U.S. patent publications 4,133,147, 1,561,727A and 2,984,052A. These documents disclose abrasive products composed of parallel abrasive threads (the weft) placed at a distance from one another and fastened to one another with transverse warp threads. The abrasive threads are fastened to the warp threads with chain stitches, meaning that the warp threads run both on the upper side and on the underside of the abrasive threads.

The brush according to U.S. Pat. No. 4,133,147 does not have on open structure since some of the warps and wefts are embedded in a uniform layer of plastic, the chain stitches provide an elastic effect and allow stretching in the longitudinal direction of the warp threads and joining the product might be problematic. The two latter point of views also hold true for the abrasive product described in U.S. Pat. No. 1,561,727. This product is indeed provided with an open structure but it can easily be understood that since the warp threads run on both sides of the abrasive threads the product rapidly breaks during abrasion.

The product described in U.S. Pat. No. 2,984,052 basically corresponds to the one described in U.S. Pat. No. 1,561,727. This product is, however, more durable than the one in U.S. Pat. No. 1,561,727, but such an improvement has been reached at the expense of a considerably inferior abrasive effect, since abrasive agent is only applied on every other crossing between the weft and warp threads.

SUMMARY

The idea of the present invention is to avoid the above drawbacks. The abrasive product according to the invention is characterized in that the base threads and the abrasive threads are placed in separate, mutually parallel planes. The fact that the base threads and the abrasive threads run in separate planes allows obtaining an abrasive product provided with an open structure and considerable tensile strength in the longitudinal direction of the base threads. Apart from the product being provided with an excellent abrasive capacity the product can easily be joined to endless belts.

Especially if the abrasive threads are placed substantially perpendicular to the base threads it is preferable that the abrasive threads are straight so that the abrasive product abrades evenly over the entire width thereof. In order to provide a most extensive abrasive surface, it is preferable that the abrasive threads are flattened so that the diameter thereof is greater in the abrasive layer plane than in a direction perpendicular to said plane.

It has become apparent that the abrasive threads do not have to be placed exactly perpendicular to the base threads, but excellent results can be achieved even if the abrasive threads form an angle with these threads that ranges between 45° and 135°, preferably between 75° and 105°. A suitable distribution between an abrasive surface and a space for the grindings is obtained if the width of the space between consecutive abrasive threads is 0.2 to 3.0 times the diameter of the abrasive threads in the abrasive layer plane, preferably 0.5 to 1.0 times the diameter.

If the base threads are placed at a distance from one another and the distance between adjacently placed base threads preferably corresponds substantially with the diameter of the threads in the base plane, then a very efficient abrasive product is achieved with an extensive working life as the grindings can be conveyed from the abrasive product through the openings between the base threads during abrasion. Such an abrasive product is in addition easy to join since the base threads can be placed to overlap in the joint. As an alternative to such an open and effective abrasive product it is nevertheless possible to assume that the base threads are arranged adjacent to one another in order to provide a substantially continuous base. An advantage with such an embodiment is that the stability of the base can be improved. The strength and stability of the product can further be improved if the base also comprises at least one layer of warp and/or weft threads.

BRIEF DESCRIPTION OF THE DRAWINGS

In the following, the invention will be described in greater detail with reference to the accompanying drawing, in which.

DETAILED DESCRIPTION OF THE PREFERRED EMBODIMENTS

Figure 1:
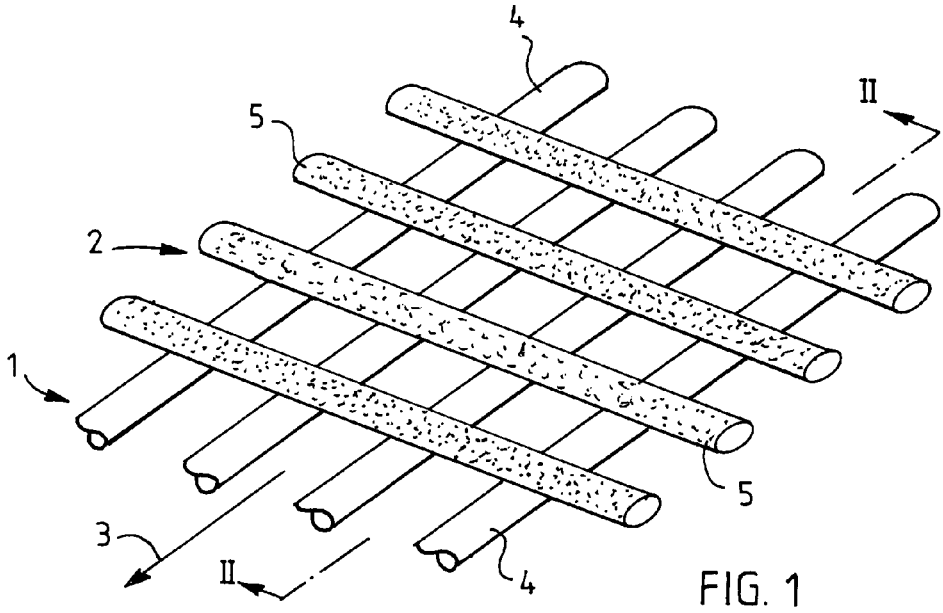
FIG. 1 shows a perspective view of a first embodiment of the abrasive product according to the invention.
Figure 2:
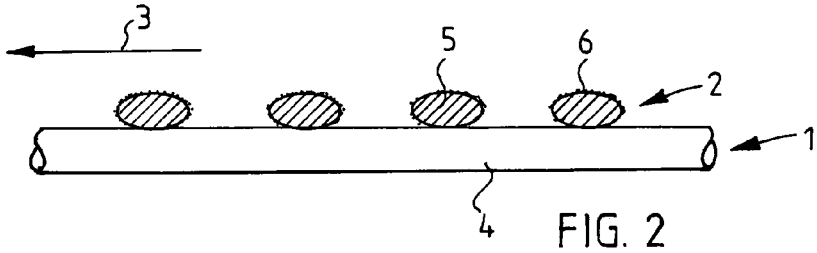
FIG. 2 shows a cross section along line II . . . II shown in FIG. 1.

The abrasive product shown in FIGS. 1 and 2 is composed of a base 1 and an abrasive layer 2. The grinding direction of the abrasive product is indicated by means of an arrow 3 and the product is preferably formed of a belt, the longitudinal direction of which coincides with the grinding direction 3.

The base 1 comprises mutually parallel straight base threads 4 extending in the one and same plane and in the grinding direction 3 of the abrasive product. The base threads 4 are placed at a distance from one another preferably so that the space between two adjacently placed threads preferably corresponds with the diameter of the thread in the base plane. The abrasive layer 2 in turn comprises mutually parallel abrasive threads 5, which are substantially straight in the vertical and lateral direction of the product, and placed transversely against the base threads 4 and the grinding direction 3. These threads are placed at a distance from one another, whereby the space between the threads preferably corresponds with the diameter of the thread in the abrasive layer plane. The threads 4 and 5 are thus placed in respective planes, which are parallel with one another and adjacent to each other. The base threads 4 form the warp threads and the abrasive threads 5 form the weft threads in the abrasive product mesh. The threads are fastened to one another at the crossings for instance with a suitable binding agent.

The threads 4 and 5 preferably comprise one or more filament bundles, in which case the abrasive threads 5 are coated with a layer of abrasive material fastened on the surface of the thread with a suitable binding agent. The inside of the threads may also be provided with abrasive material. The abrasive threads 5 are of a flattened shape, and thereby the diameter thereof is greater in the abrasive layer plane than in a direction perpendicular to said plane. A contributory cause to the flattening is the calibration of the abrasive product that is carried out when manufacturing the product, thus ensuring that all abrasive threads abrade equally. The diameter of the abrasive threads in the abrasive layer plane typically ranges between 0.3 and 6.0 mm, preferably between 0.5 and 3.0 mm.

Figure 3:
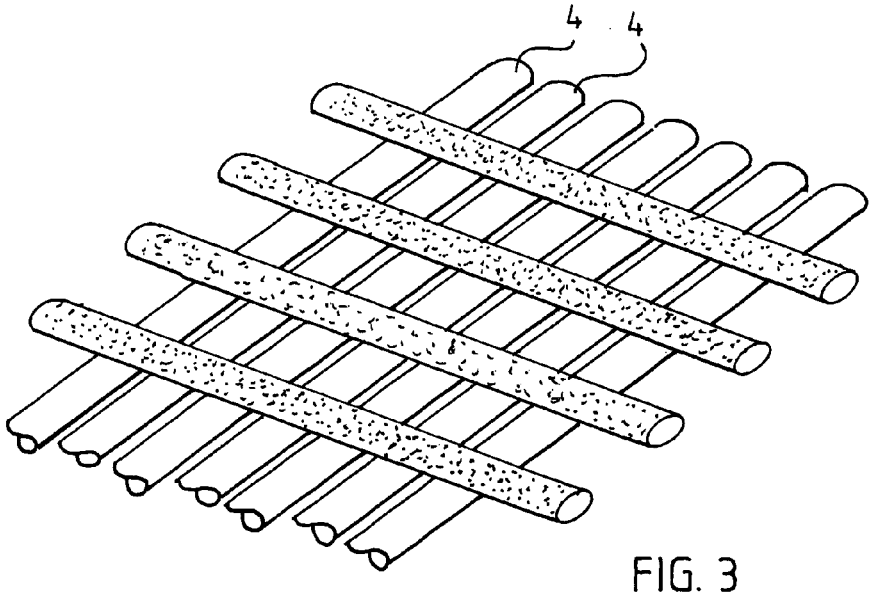
FIG. 3 shows a second embodiment of the abrasive product according to the invention and FIGS. 4 and 5 show how a joint is made.

FIG. 3 shows an alternative embodiment of the abrasive product according to the invention. In this case the base threads 4 are placed substantially adjacent to one another in order to provide a substantially continuous base. In other respects this embodiment is in accordance with what is shown in FIGS. 1 and 2.

Figure 4:
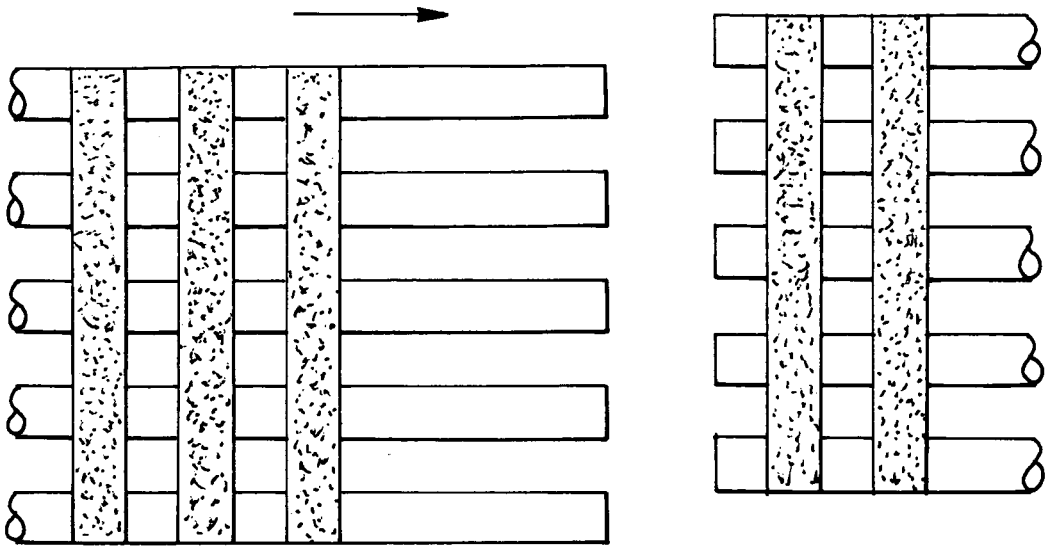
Figure 5:
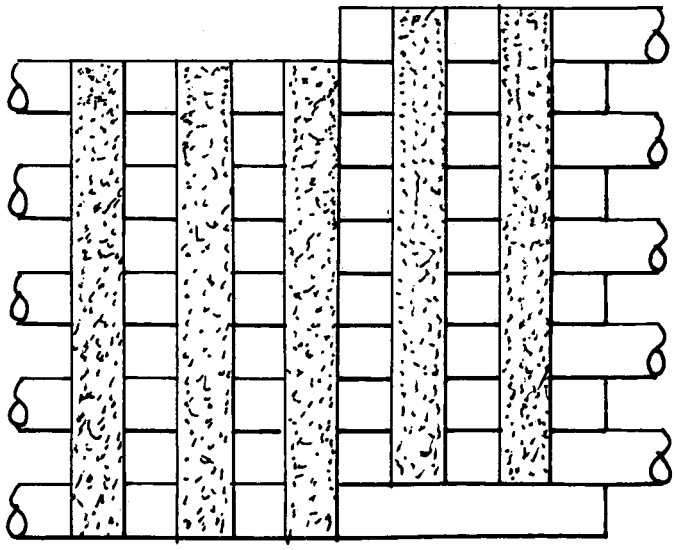

FIGS. 4 and 5 show how the ends of an abrasive belt are joined to provide an endless abrasive belt. Before carrying out the joining one or more, two in the example shown, abrasive threads 5 at one end of the abrasive belt are removed so that the base threads 4 form elongated free fingers. These fingers are pushed into the spaces between the base threads 4 in the other end of the abrasive belt, and thereafter the abrasive threads in the other end are fastened to the projecting fingers; cf. FIG. 5. The abrasive product according to the invention thus allows to easily provide a durable joint. A single abrasive thread 5 can alternatively be removed from both ends of the abrasive belt.

As shown in FIGS. 1 to 3, a level difference exists between the base threads 4 and the abrasive threads 5 as a result of the abrasive threads being arranged on the surface of the base. Such a level difference makes it possible to coat the abrasive threads 5 only with an abrasive material 6. Since only the transversely placed threads perform the abrasive work, there is no risk that the object to be abraded obtains stripes from longitudinal abrasive threads. The base threads 4 preferably comprise untwined or very slightly twined filament bundles, while the bundles of abrasive threads 5 are preferably more twined in order to provide the threads with more volume and to obtain a difference in height in relation to the base threads. On account of this difference in height, only the abrasive threads 5 normally come in contact with the object to be abraded.

Deviating from the above the abrasive threads 5 may form a different angle than that of 90° with the base threads 4. The angle may range between 45° and 135°, preferably, however, between 75° and 105°. An advantage with oblique abrasive threads is that the course of the abrasion becomes smoother and the abrasive product therefore lasts longer. Even the base threads 4 may form an angle with the grinding direction 3 of the product, however, preferably of 30° at the most.

In order to stabilize the base it is naturally possible to supplement the base threads 4 with at least one additional layer of threads that runs in the longitudinal direction, in the transverse direction or at other angles in relation to the grinding direction 3.

Owing to the open structure of the present abrasive product, the significant tensile strength thereof in the grinding direction and the possibility to carry out a simple joining, the present abrasive product provides a considerable improvement in comparison with the prior art abrasive products. The open structure thereof also provides good chances to actively remove the grindings from the product during abrasion, for instance by providing low pressure on the abrasive side of the abrasive product and a high pressure on the opposite side.

The invention claimed is:

1. An abrasive product composed of a base comprising mutually parallel base threads; and an abrasive layer comprising mutually parallel abrasive threads placed at a distance from one another leaving open space between consecutive abrasive threads;

wherein the abrasive threads run substantially transversely in relation to the base threads and are fastened thereto;

wherein the base threads and the abrasive threads are placed in two separate, mutually parallel planes; and wherein the abrasive threads are at least partly coated with an abrasive material.

2. An abrasive product as claimed in claim 1, wherein the abrasive threads are straight and run substantially perpendicularly against the base threads.

3. An abrasive product as claimed in claim 2, wherein the abrasive threads are flattened in such a manner that the diameter thereof is greater in the abrasive layer plane than in a direction perpendicular to said plane.

4. An abrasive product as claimed in claim 1, wherein the abrasive threads form an angle with the base threads that ranges between 45° to 135°, preferably between 75° to 105°.

5. An abrasive product as claimed in claim 1, wherein the width of the space between consecutive abrasive threads is 0.2 to 3.0 times the diameter of the abrasive threads in the abrasive layer plane, preferably 0.5 to 1.0 times the diameter.

6. An abrasive product as claimed in claim 1, wherein the abrasive threads are formed of one or more filament bundles and wherein abrasive material is arranged on the surface of the threads.

7. An abrasive product as claimed in claim 1, wherein the base threads are straight and placed at a distance from one another, whereby the distance between adjacent base threads substantially corresponds with the diameter of the threads in the base plane.

8. An abrasive product as claimed in claim 1, wherein the base threads are adjacent to one another in order to provide a substantially continuous base.

9. An abrasive product as claimed in claim 1, wherein the base also includes at least one layer of warp and/or weft threads.

10. An abrasive product as claimed in claim 1, wherein the product forms a belt, in which the base threads run substantially in the longitudinal direction of the belt and the abrasive threads run substantially in the transverse direction of the belt.

* * * * *